US005611470A

United States Patent [19]

Vias et al.

[11] Patent Number: 5,611,470

[45] Date of Patent: Mar. 18, 1997

[54] TAMPER RESISTANT POUCH FOR CHILD SECURITY DEVICE

[76] Inventors: Pamela S. Vias; Steven J. Vias, both of P.O. Box 672061, Marietta, Ga. 30067

[21] Appl. No.: 396,743

[22] Filed: Mar. 1, 1995

[51] Int. Cl.[6] ..... A45F 5/00

[52] U.S. Cl. ..... 224/240; 224/930

[58] Field of Search ..... 224/253, 235, 224/250, 930, 240

[56] References Cited

U.S. PATENT DOCUMENTS

| | | | |
|---|---|---|---|
| D. 104,572 | 5/1937 | Lewis . | |
| D. 287,305 | 12/1986 | Brown . | |
| 1,558,228 | 10/1925 | Botkin . | |
| 1,606,667 | 11/1926 | Rosenberg . | |
| 1,903,798 | 4/1933 | Turner | 224/235 X |
| 1,927,706 | 9/1933 | House | 224/235 X |
| 4,440,525 | 4/1984 | Perla . | |
| 4,525,879 | 7/1985 | Kalomeris . | |
| 4,569,465 | 2/1986 | O'Farrell . | |
| 4,923,105 | 5/1990 | Synder . | |
| 5,082,157 | 1/1992 | Emerson-Santos . | |
| 5,244,136 | 9/1993 | Collaso | 224/253 |

*Primary Examiner*—Renee S. Luebke
*Attorney, Agent, or Firm*—Randy W. Lacasse

[57] ABSTRACT

A tamper resistant pouch for a child security device consisting of a pouch with parallel attachment loops that impede the opening of the pouch after a belt has been passed through the attachment loops. The tamper resistant pouch and belt are submergible.

9 Claims, 2 Drawing Sheets

TAMPER RESISTANT POUCH FOR CHILD SECURITY DEVICE

BACKGROUND OF THE INVENTION

1. Field of Invention

The field of the invention relates, in general, to a tamper resistant pouch that restricts removal of the contents of the pouch when used in conjunction with a belt or strap. More particularly, the invention provides for a tamper resistant carrying pouch for a small electronic device that can be secured to a child so that a parent may be alerted if the child wanders out of a specified range or falls into a body of water.

2. Discussion of Prior Art

In today's world, child safety is a growing concern that most parents take seriously. With the recent increase in crimes against children and reports of terrible accidents occurring to children who wander into dangerous situations, there exists a need for a device to alert parents or guardians that a child has left a prescribed area or fallen into a hazard. One such device is a pager device worn by a child that transmits a constant signal to a receiver unit worn by the parent. If the transmitted signal is weakened by the child leaving a designated area or falling into a hazard, then the parent's receiver unit sounds an alert signal so that the parent can assist the child. For the unit to operate properly or to be effective, the child's transmitter unit must stay secured to the child. If the child is curious and removes the device to inspect it or play with it, then the intended purpose of the device is defeated when the child discards or accidentally drops the device. Additionally, a criminal with malicious intent might discard the device in order to perpetrate a crime against the child.

In view of the fact that there are many dangers in today's world that a child may encounter, there exists a need for a tamper resistant pouch to carry a pager device for a child's safety.

The prior art has heretofore afforded various apparatuses to carry pager devices or other objects. Many of these apparatuses are designed to attach to a belt or strap. However, none of these apparatuses are designed so that once attached or secured, they are extremely difficult to open. Thus, with the prior art devices, removal of the contents of the pouch apparatus is not restricted.

The instant invention solves this problem by providing for a pouch that, when secured, restricts removal of the contents therein. Thus, the instant invention provides for a tamper resistant pouch for a child security device that restricts the removal of the contents from the pouch.

SUMMARY OF THE INVENTION

As shown by the lack of any tamper resistant pouch in the prior art, there exists a need for a tamper resistant pouch that will restrict the removal of the contents therefrom.

It is therefore an object of the invention to provide for a tamper resistant pouch that restricts the removal of the contents therefrom when in a secured position.

It is another object of the invention to provide for a tamper resistant pouch that restricts a child from inadvertently dropping or removing the contents therefrom.

It is another object of the invention to provide for a tamper resistant pouch secured to a belt with a high tension release mechanism that makes removal of the belt difficult.

It is another object of the invention to provide for a tamper resistant pouch that is submergible.

These and other objects of the invention will become evident when taken in conjunction with the drawings, claims and description of the preferred embodiments of the invention.

DESCRIPTION OF THE PREFERRED EMBODIMENTS

Figure 1:
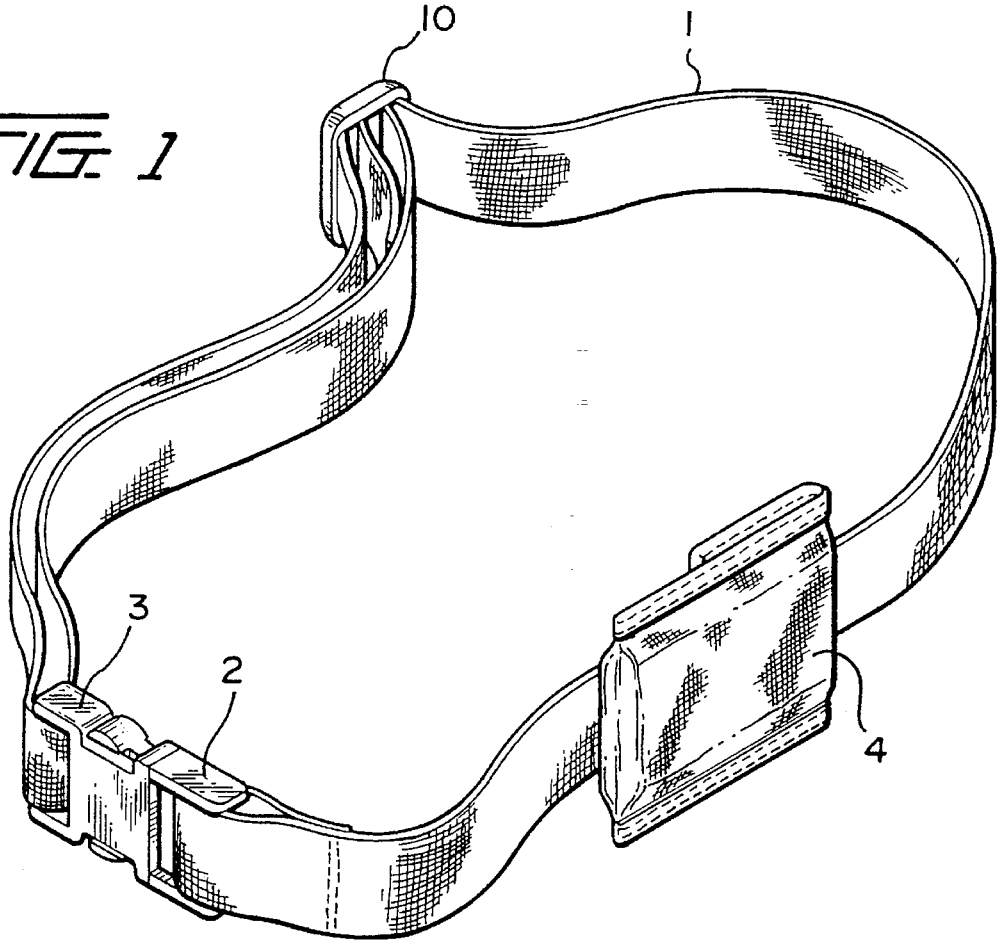
FIG. 1 illustrates an embodiment of the invention showing a tamper resistant pouch used in conjunction with a belt.

FIG. 1 illustrates an implementation of the present invention consisting of a belt 1, adjustable in length by buckle 10, secured by a male fastening element 2 which is receivably connected to a female fastening element 3. A tamper resistant pouch 4 is attached to belt 1.

Belt 1 and pouch 4 are made of nylon or other equivalent materials that do not compromise the integrity of the design if it becomes wet (i.e. no shrinkage, expansion, loss of stitching). Since the pager device 9 (as shown in FIG. 3) is designed to alert the parent's receiver if the child falls into a hazard such as water, the belt 1 and pouch 4 are made of materials that are submergible.

Figure 2:
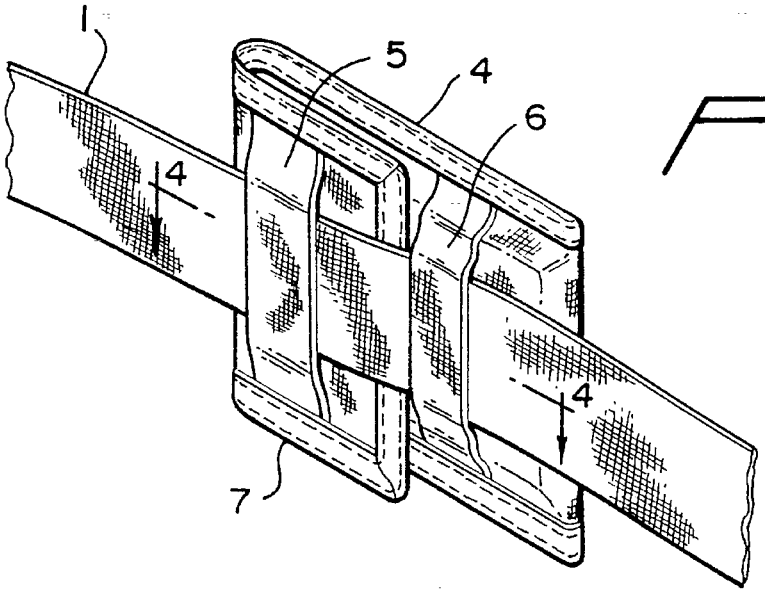
FIG. 2 illustrates an embodiment of the invention with the belt passing through attachment loops.

FIG. 2 illustrates the belt 1 passing through attachment loops 5, 6 of the closed pouch 4. The pouch is closed by folding closure flap 7 over the opening of pouch 4 and securing it to the outside of the pouch 4 with VELCRO™, hook and loop strips 8 (as shown in FIG. 3).

The outer surface of the closure flap 7 has an attachment loop 5 parallel to the direction of the pouch 4 opening. The outer surface of the pouch 4 to which the closure flap 7 is secured has an attachment loop 6 parallel to the attachment loop 5 on the outer surface of the closure flap 7. The exact placement of these attachment loops 5, 6 is not essential other than, when folded, the belt 1 passes through both attachment loops 5, 6 and one attachment loop 5 must be on closure flap 7 and one attachment loop 6 must be on pouch 4.

Figure 3:
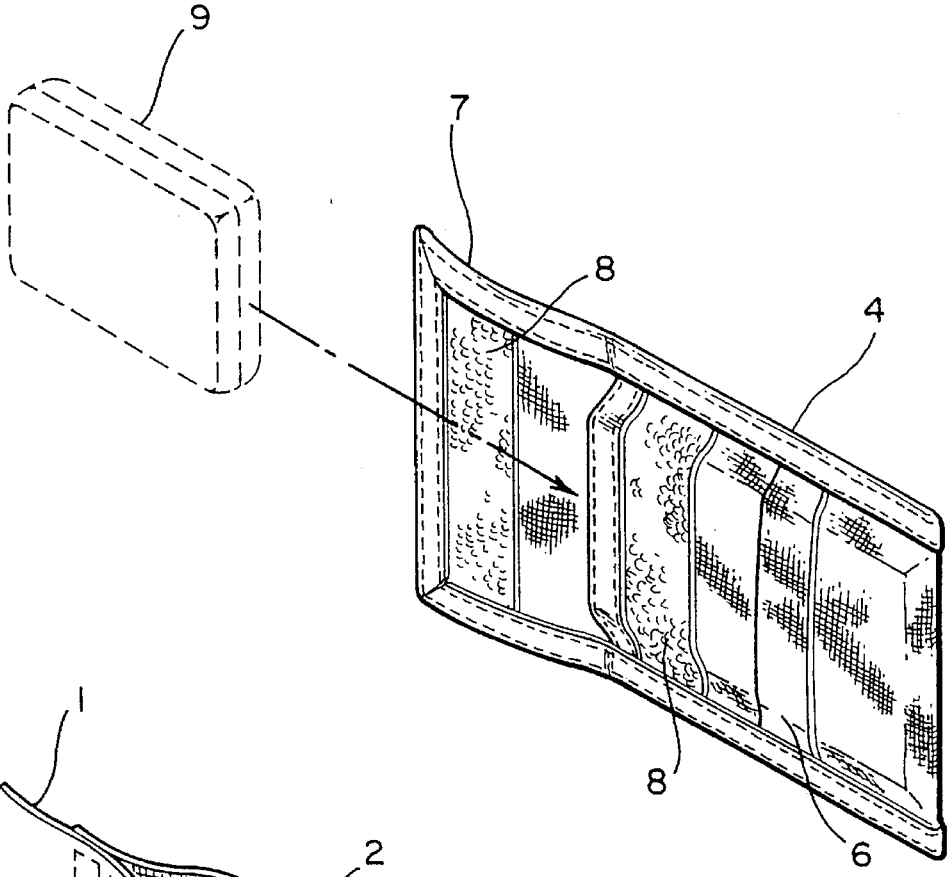
FIG. 3 illustrates an embodiment of the invention with a pager device being placed into the tamper resistant pouch.
Figure 5:
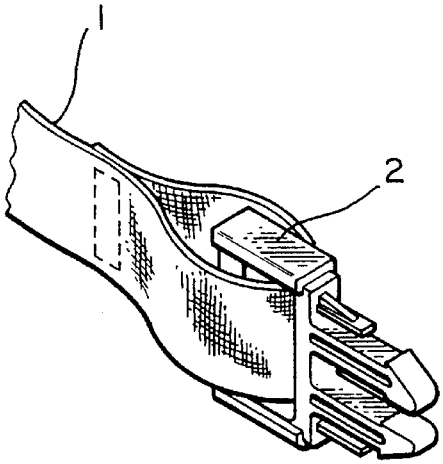
FIG. 5 illustrates a male fastening element of the belt 1.

FIG. 3 illustrates the male fastening element 2 of the belt 1 that is inserted into the female fastening element 3. The invention envisions other known functionally equivalent connectors. The fastening elements 2, 3 have a high tension release mechanism to make removal of the belt 1 difficult, especially for small children.

A pager device 9 or other article is placed inside of the pouch 4. After the pager device 9 is inside of the pouch 4, the closure flap 7 is folded over the pouch 4 opening and fastened to the pouch 4 by VELCRO™, hook and loop strips 8. The attachment loops 5, 6 on the outer surfaces of the pouch 4 and closure flap 7 are now lined up to receive belt 1.

The pouch 4 is attached to belt 1 by sliding one end of the open belt 1 through both attachment loops 5, 6. The belt 1 is then secured to the child. In the secured position, the belt 1 impedes opening of the closure flap 7 or removal of the pager device 9.

Figure 4:
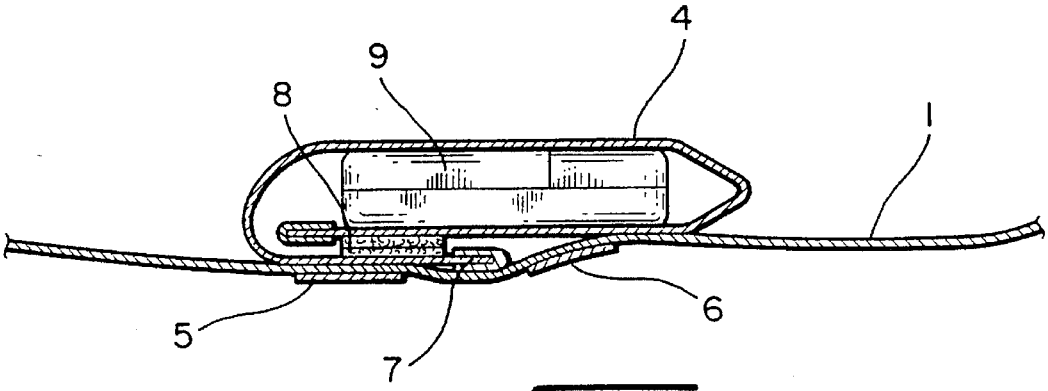
FIG. 4 illustrates a cross section of the tamper resistant pouch with a pager device inside of the pouch and the pouch secured to a belt.

FIG. 4 illustrates a cross section of the pouch 4 with a pager device 9 inside of the pouch 4. The belt 1 is shown passing through the attachment loops 5, 6.

A system and method has been shown for the effective implementation of a tamper resistant pouch for restricting the removal of the contents, for example a child security device, therefrom. While a preferred embodiment has been shown and described, it will be understood that there is no intent to limit the invention by such disclosure, but rather, is intended to cover all modifications and alternate constructions falling within the spirit and scope of the invention as defined in the appended claims. The invention should not be limited by size, shape and/or materials. In addition, the VELCRO™, hook and loop fastening strips may be replaced by any known equivalent fastening means as is known in the art. Further, the pouch could be worn separately from the belt shown (i.e. with dress belt).

We claim:

1. A tamper resistant pouch for carrying an article, said pouch attachable to a belt or strap and comprising:

an article receiving means;

a closure flap having a first and second end, said closure flap retaining said article and said first end integral with said article receiving means;

a first loop on an outer surface of said article receiving means;

a second loop on an outer surface of said closure flap means, and wherein said first and second loops become aligned during closure of said closure flap and said belt or strap is threaded therethrough thereby restricting opening of said closure flap and preventing removal of said article.

2. A tamper resistant pouch for carrying an article, said pouch attachable to said belt or strap, as per claim 1, wherein said article is an electronic device.

3. A tamper resistant pouch for carrying an article, said pouch attachable to said belt or strap, as per claim 2, wherein said electronic device is a pager.

4. A tamper resistant pouch for carrying an article, said pouch attachable to said belt or strap, as per claim 1, with fastening means to attach said second end of said closure flap to said article receiving means.

5. A tamper resistant pouch for carrying an article, said pouch attachable to said belt or strap, as per claim 1, wherein said pouch and said belt are submergible.

6. A tamper resistant pouch for carrying a pager, said pouch attachable to a said belt or strap comprising:

a pager receiving means;

a closure flap having a first and second end, said closure flap retaining said pager and said first end integral with said pager receiving means;

a fastening means to attach said second end of said closure flap to said pager receiving means;

a first loop on an outer surface of said receiving means;

a second loop on an outer surface of said closure flap means, and wherein said first and second loops become aligned during closure of said closure flap and said belt or strap is threaded therethrough thereby restricting opening of said closure flap and preventing removal of said pager.

7. A tamper resistant pouch for carrying a pager, said pouch attachable to said belt or strap, as per claim 6, wherein said pouch and said belt are submergible.

8. A tamper resistant pouch for carrying a child safety pager, said pouch attachable to a belt or strap comprising:

a child safety pager receiving means;

a closure flap having a first and second end, said closure flap retaining said child safety pager and said first end integral with said child safety pager receiving means;

a fastening means to attach said second end of said closure flap to said child safety pager receiving means;

a first loop on an outer surface of said receiving means;

a second loop on an outer surface of said closure flap means;

a belt or strap with a child-proof buckle, and wherein said first and second loops become aligned during closure of said closure flap and said belt or strap is threaded therethrough and connected by said child-proof buckle thereby restricting opening of said closure flap and preventing removal of said child safety pager.

9. A tamper resistant pouch for carrying a child safety pager, as per claim 8, wherein said pouch and belt are submergible.

* * * * *

UNITED STATES PATENT AND TRADEMARK OFFICE

CERTIFICATE OF CORRECTION

PATENT NO. : 5,611,470
DATED : March 18, 1997
INVENTOR(S) : Vias et al

It is certified that error appears in the above-indentified patent and that said Letters Patent is hereby corrected as shown below:

Column 4, line 5, delete "said".

Signed and Sealed this

Twenty-seventh Day of May, 1997

*Attest:*

Bruce Lehman

BRUCE LEHMAN

*Attesting Officer*

*Commissioner of Patents and Trademarks*